United States Patent [19]

Birx et al.

[11] Patent Number: 4,646,027

[45] Date of Patent: Feb. 24, 1987

[54] ELECTRON BEAM ACCELERATOR WITH MAGNETIC PULSE COMPRESSION AND ACCELERATOR SWITCHING

[75] Inventors: Daniel L. Birx, Brentwood; Louis L. Reginato, Orinda, both of Calif.

[73] Assignee: The United States of America as represented by the United States Department of Energy, Washington, D.C.

[21] Appl. No.: 592,302

[22] Filed: Mar. 22, 1984

[51] Int. Cl.[4] ..... H05H 1/46

[52] U.S. Cl. ..... 328/233

[58] Field of Search ..... 328/233, 59, 67; 250/396, 396 ML; 363/59; 307/110

[56] References Cited

U.S. PATENT DOCUMENTS 4,274,134 6/1981 Johannessen ..... 363/59
4,275,317 6/1981 Laudenslager et al. ..... 307/415

OTHER PUBLICATIONS

"High Voltage, Magnetically Switched Pulsed Power System", VanDevender et al., pp. 256–261; presented at 1981 Pulsed Power Conference.
"Experiments in Magnetic Switching", by Birx et al, pp. 262–268, presented at 1981 Pulsed Power Conference.
"Economic Design of Saturating Reactor Magnetic Pulsers", Mathias et al., pp. 169–171; AIEE Winter General Meeting, 5/1955.
"Coil Pulsers for Radar", by Peterson, pp. 603–615; Bell Technical Journal (1946).
"Magnetic Pulse Modulators", Busch et al., pp. 943–993; Bell System Technical Journal, Sep. 1955.
The Proceedings of the Institution of Electrical Engineers, Part III, No. 53, May 1951, vol. 98, p. 185, "The Use of Saturable Reactors as Discharge Devices for Pulse Generators", by W. S. Melville.
"Pulse Generators", Glasoe et al, 1948, pp. 470–477, McGraw Hill.
"Experimental Test Accelerator", Hester et al., Mar. 1979, Lawrence Livermore Laboratory preprint.
"Basic Principles Governing the Design of Magnetic Switches", Birx et al, Nov. 1980, Lawrence Livermore Laboratory report.
*Energy and Technology Review*, 12/1981, p. 1, "Generating Intense Electron Beams for Military Applications".
"An Investigation into the Repetition Rate Limitations of Magnetic Switches", Birx et al., Feb. 1982, Lawrence Livermore Laboratory preprint.
"Regulation and Drive System for High Rep-Rate Magnetic Pulse Compressors", Birx et al, May 1982, Lawrence Livermore Laboratory preprint.
"The Application of Magnetic Pulse Compression to the Grid System of the ETA/ATA Accelerator", Birx et al., 1982, Lawrence Livermore Laboratory.
"The Application of Magnetic Switches as Pulse Sources for Inductor Linacs", Birx et al., Mar. '83, Lawrence Livermore Laboratory preprint.
"Magnetic Switching", Birx et al., 6/83, Lawrence Livermore Laboratory preprint.
*Energy and Technology Review*, 8/83, p. 11, Birx.

*Primary Examiner*—Palmer C. DeMeo
*Assistant Examiner*—Sandra L. O'Shea
*Attorney, Agent, or Firm*—John F. Schipper; Clifton E. Clouse, Jr.; Judson R. Hightower

[57] ABSTRACT

An electron beam accelerator comprising an electron beam generator-injector to produce a focused beam of ≧0.1 MeV energy electrons; a plurality of substantially identical, aligned accelerator modules to sequentially receive and increase the kinetic energies of the beam electrons by about 0.1–1 MeV per module. Each accelerator module includes a pulse-forming network that delivers a voltage pulse to the module of substantially 0.1–1 MeV maximum energy over a time duration of ≦1 μsec.

8 Claims, 7 Drawing Figures

ELECTRON BEAM ACCELERATOR WITH MAGNETIC PULSE COMPRESSION AND ACCELERATOR SWITCHING

FIELD OF THE INVENTION

This invention relates to generation and acceleration of charged particle beams to produce high energy, high current pulses of duration less than 1 μsec.

The U.S. Government has rights in this invention pursuant to Contract No. W-7405-ENG-48 between the U.S. Department of Energy and the University of California, for the operation of the Lawrence Livermore National Laboratory.

BACKGROUND OF THE INVENTION

Pulse power applications, such as production of a high energy electron beam over a time period of 1 μsec. or less, require beam accelerator modules that operate over correspondingly brief time intervals with reasonable energy efficiency, preferably 50 percent or higher. End uses for resulting charged particle beams include injection of charge particle species into a plasma confinement device, preservation of food and defense applications. One attractive approach for production of an abbreviated, high voltage pulse for the accelerator module(s) uses a little-known technique of non-linear or saturable inductors in an appropriate capacitive-inductive ladder network first discussed by W. S. Melville in *Proceedings of the Institution of Electrical Engineers,* Vol. 98, Part III, pp. 185–208 (May 1951). The method examined by Melville yields foreshortened pulses but may not improve the ratio of pulse rise time or pulse fall time to the time period of pulse plateau, which ratio should be as small as possible to produce pulses reasonably close to square waves in shape.

SUMMARY OF THE INVENTION

One object of this invention is to provide electron acceleration apparatus to accelerate electrons to high energy and high current density in pulses of $\leqq 1$ μsec. duration (FWHM).

Another object is to provide electron acceleration apparatus with controllable repetition rates up to about 20 kilohertz.

Other objects of the invention, and advantages thereof, will become clear by reference to the detailed description and accompanying drawings.

To achieve the foregoing objects, the invention in one embodiment may comprise: initial energy storage means, having an output terminal, to produce a voltage pulse of time duration substantially $\geqq 1$ microsecond and voltage $\geqq 10$ kV at the storage means output terminal; and a magnetic compression network, with an input terminal and an output terminal, coupled to the output terminal of the initial energy storage means, for receiving at its input terminal the one microsecond voltage pulse from the initial energy storage means and for producing at its output terminal a $\geqq 100$ kV voltage pulse of duration $\geqq 20$ nanoseconds with a $\geqq 5$ nanosecond rise time and fall time, the network comprising: a grounded capacitor connected at one end to the output terminal of the initial energy storage means; a first saturable inductor having two ends and having inductances satisfying $L^{(unsat.)}/L^{(sat.)} \geqq 100$, connected to the initial energy storage means output terminal at the first end of the first inductor; a first water-filled pulse transmission line having two ends and having impedance of substantially $\geqq 0.1$ ohms, connected at one end to the second end of the first saturable inductor; a second saturable inductor having two ends and having inductances satisfying $L^{(unsat.)}/L^{(sat.)} \geqq 100$, connected at one end to the second end of the first water-filled pulse transmission line; a second water-filled pulse transmission line having two ends, of impedance substantially $\geqq 0.1$ ohms, connected at one end to the second end of the second saturable inductor; a voltage step-up transformer, having input and output terminals, coupled at its input terminal to the second end of the second pulse transmission line; and a third saturable inductor having two ends and having inductances satisfying $L^{(unsat.)}/L^{(sat.)} \geqq 100$, connected at one end to the output terminal of the voltage transformer and connected at its second end to a load to which the output pulse is to be delivered.

The present invention produces a pulse shortening by a factor of the order of 20 or more and squares the pulse. This is useful, for example, in accelerators for electron beams having a time duration of 1 μsec. or less.

DETAILED DESCRIPTION

The apparatus described here, called simply an improved ATA, is the latest in a series of charged particle induction accelerators developed by the Lawrence Livermore National Laboratory (LLNL) and the Lawrence Berkeley National Laboratory (LBNL). The resulting charged particle beams have utility for injecting energetic charged particles into plasma confinment apparatus, for food preservation and for defense applications. Table I compares five of the most important parameters of four of these accelerators, including the ATA. As compared to the earliest of these accelerators, the Astron II, the ATA has achieved an eight-fold increase in beam energy, a twelve-fold increase in current, a six-fold decrease in the time duration of the pulse produced and a modest increase in burst (repetition) rate in about 15 years of development; the improved ATA carries this further, allowing burst rates of up to 20,000 Hz. and other improvements. Table II provides a comparison of parameters of previous spark gap technology. ATA magnetic compression operating points, and operating ranges for use with the invention.

TABLE I

Comparison of original ATA with earlier induction accelerators.

| | Astron II | ERA | ETA | ATA |
|---|---|---|---|---|
| Beam energy, MeV | 6 | 4 | 4.5 | 50 |
| Current kA | 0.8 | 1.2 | 10 | 10 |
| Pulse length, ns | 300 | 30 | 40 | 70 |
| Burst rate, Hz | 800 | 2 | 1000 | 1000 |
| Average rate, Hz | 5 | 2 | 5 | 5 |

TABLE II

| Parameter | Previous Spark Gap Technology | ATA Magnetic Compression | Invention Technology Ranges |
|---|---|---|---|
| Peak output power, GW | 2.5 | 10 | 1 to 1000 |
| Pulse rise time (10%–90%) per cell, ns | 18 | 15 | 5 to 100 |
| Pulse length (FWHM), ns | 70 | 80 | 10 to 10,000 |
| Pulse energy J | 350 | 800 | 1 to 100,000 |
| Efficiency (including resonant transformer), % | 70 | 80 | 30 to less 100 |
| Voltage (2-cell driver) at 18 kA/cell, kV | 100 | 300 | Arbitrary with number of accelerator modules driven |
| Voltage (1-cell driver) at 25 kA/cell, kV | 200 | 450 | Arbitrary with number of accelerator modules driven |
| Pulse-to-pulse jitter at up to 1 kHz, ns | ±1 | ±0.5 | ±0.5 |
| Peak burst rate (5 pulses), kHz | 1 | >10 | 1 pulse per second to 100 MHz |
| Peak average repetition rate at 10% duty factor, kHz | 0.1 | 1 | 0.1 to 25 |

Figure 1:
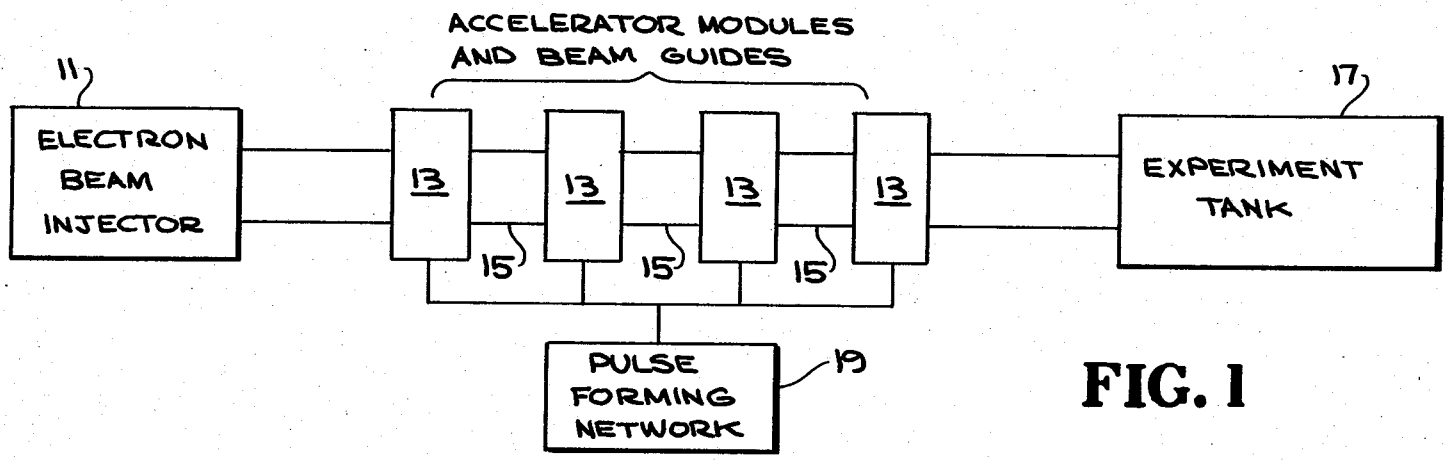
FIG. 1 is a schematic diagram of the major components of one embodiment of the invention.

With reference to the schematic diagram in FIG. 1, the improved ATA facility consists of four or five major components: an electron beam injector to generate a focused beam of electrons of substantially ≧0.1 MeV energy each, 11; a plurality of substantially identical, aligned accelerator modules, 13, to sequentially receive and increase the kinetic energies of the beam electrons by about 0.1–1.0 MeV per module; a plurality of static magnetic field sources, 15, one being positioned between each two consecutive accelerator modules to guide the electron beam from one module to the next; an optional utilization tank, 17, to receive the energetic electron beam and perform useful functions therewith and a closed container, 18, surrounding the other components in an air-tight manner to maintain an internal pressure of no more than about $10^{-4}$ Torr. Each accelerator module includes a pulse-forming network, 19, that delivers a voltage pulse of about 0.1–1.0 MeV over a time duration of ≦1 μsec. FWHM (nominally, a ≧10 nanoseconds plateau) to the remainder of the module in timed relationship with arrival of the electron beam at the module.

Figure 2:
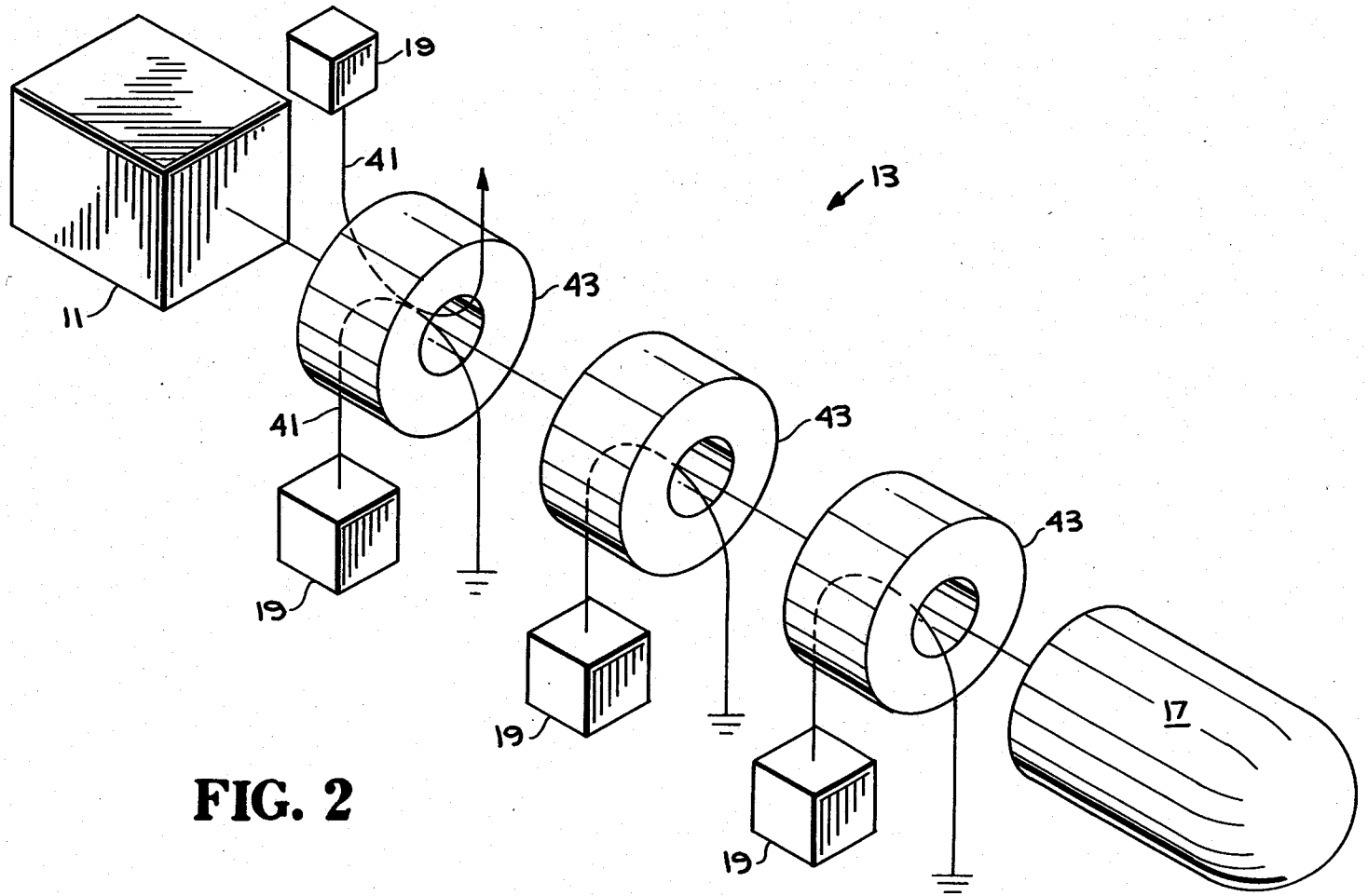
FIG. 2 is a perspective schematic view of the electron beam generator, several aligned accelerator modules and corresponding pulse-forming networks and the utilization tank.

FIG. 2 shows the relationship of the electron beam injector 11, several of the aligned accelerator modules 13 and the utilization tank 17. One loop of a lead wire or other electrical conductor, 41, coming from a pulse-forming network, 19, winds through a ferrite core 43, as shown, to induce a rapid change in flux in the core as a result of passage of about a ≦1 μsec. voltage pulse along each lead wire. The single toroids can be ferrite of PE11B material, such as is supplied by TDK, or the Metglas® 2605 material supplied by Allied Corporation or any thin (less than about 0.6 mil) amorphous magnetic material. The total flux swing from this ferrite is about 6 kilogauss (0.6 Webers/$M^2$) with a coercive force of about 0.25 Oersteds. It is this rapid change in time of flux or magnetic induction, B, that produces the accelerating electric field adjacent to the toroid for the electron beam as the electron beam passes along the toroid axis. The total flux swing of the amorphous magnetic materials can be as high as 2.5–3.0 Webers/$M^2$.

Figure 3:
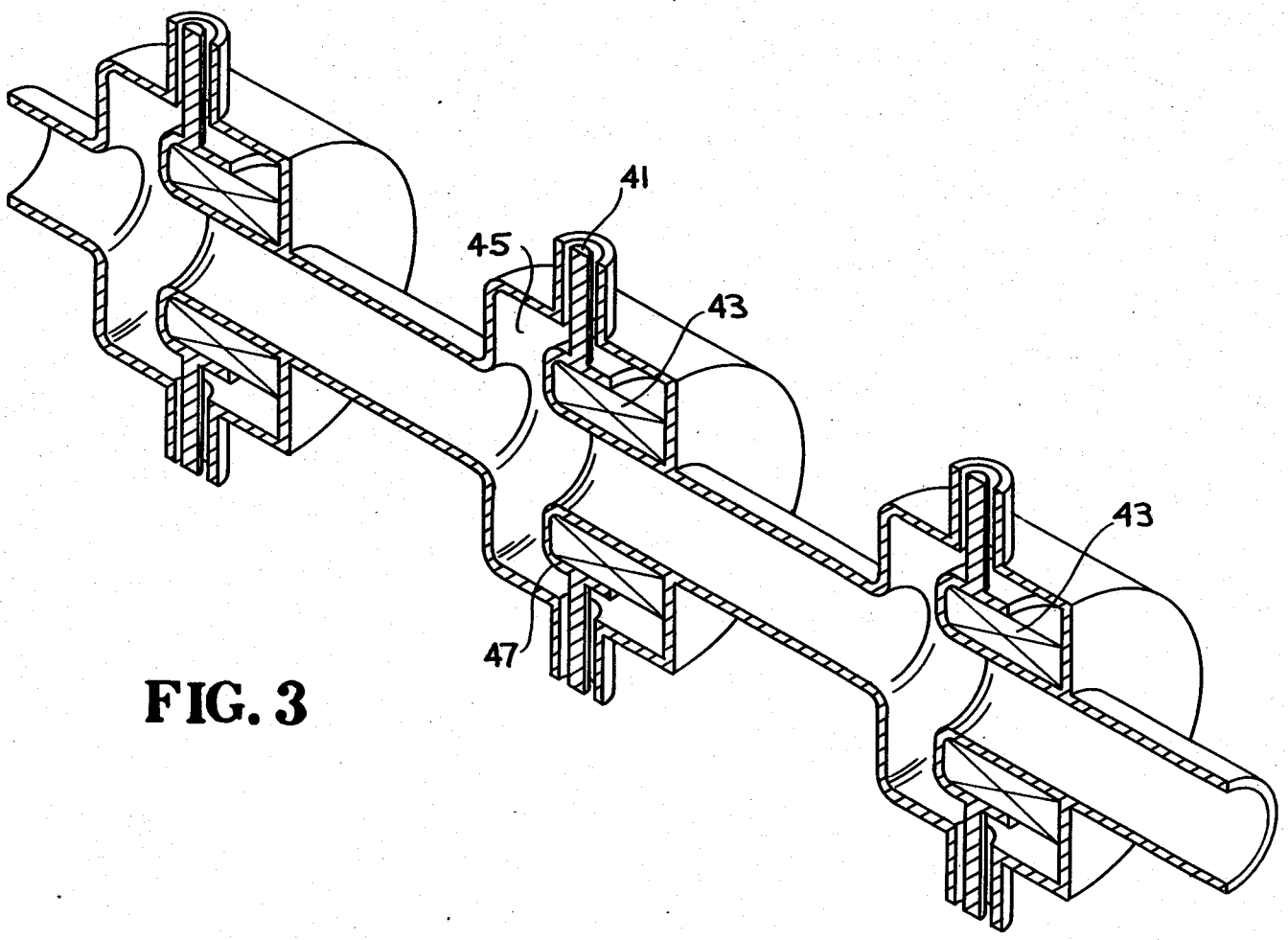
FIG. 3 is a cross-sectional view of several of the aligned accelerator modules.

FIG. 3 is a cross-sectional view of three of the accelerator modules, showing the electron beam current passing along the common central axis of the toroids, the ferrite cores 43, the accelerator gap, 45, associated with each accelerator module, the lead wire 41 for the high voltage pulse delivered symmetrically to each "half" of an accelerator module and an electrical conductor, 47, to provide the single turn around the ferrite core of each accelerator module and act as a path for return current.

Figure 4:
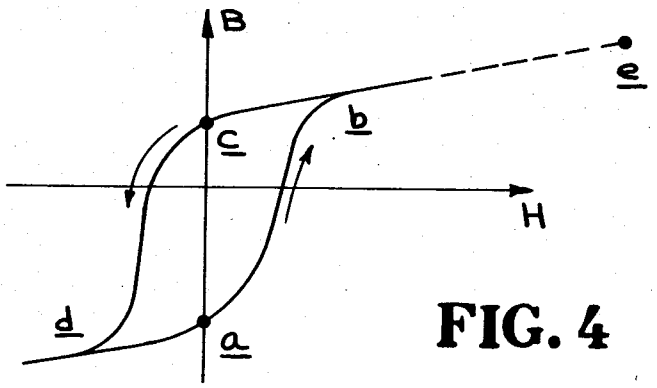
FIG. 4 is a graphic view of a representative hysteresis curve of a ferromagnetic material useful in the invention.

With reference to FIG. 4, showing schematically the development of magnetic induction, B, in a ferromagnetic material as a function of the magnetic intensity H (proportional to applied current), initially the ferrite core is at a point a on the hysteresis curve corresponding to substantially zero magnetic intensity. As the magnetic intensity is rapidly increased, the operating point of the ferrite moves to point b approximately at the "knee" of the hysteresis curve; after the voltage pulse and corresponding current has passed, the operating point of the ferrite relaxes from b to c to d and finally back to the initial point a after the reset pulse. The points on the operating curve corresponding to initial ferrite operating point (a) and the ferrite operating point at the time of the passage of the voltage pulse (b), are chosen carefully so that the material does not move appreciably beyond the "knee" of the hysteresis curve; this provides maximum efficiency as to the flux swing and corresponding accelerating voltage pulse developed by the ferrite core.

Figure 5:
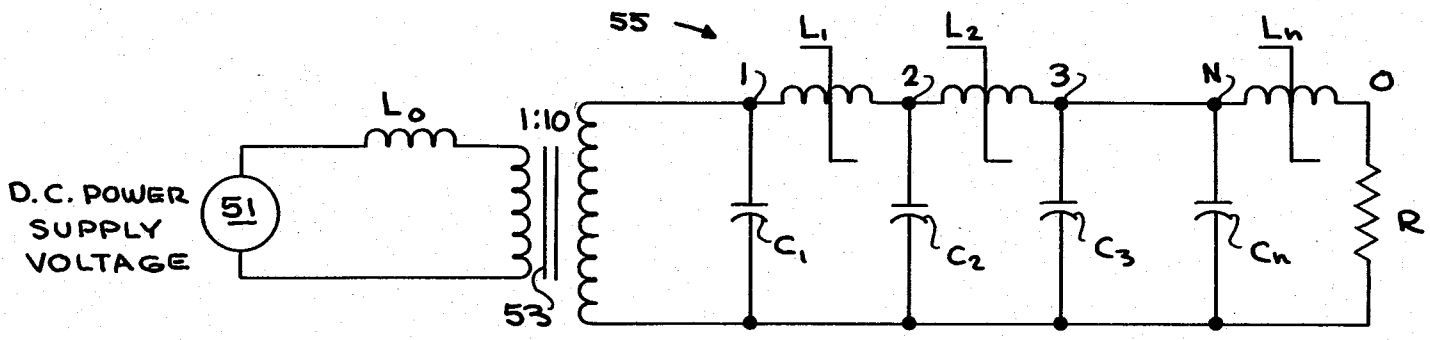
FIG. 5 is a schematic view of a capacitive-inductive ladder network useful in magnetic pulse compression in an earlier approach.

The pulse-forming network uses magnetic compression of a pulse in time (by a factor of about 150) to achieve reproducible, high efficiency (about 30–95%), high repetition rate voltage pulses of time duration ≦1 μsec. to drive the accelerator modules. FIG. 5 shows a simple magnetic compression ladder network to produce shortened pulses, using the apparatus of Melville. One begins with an ac power supply, 51, coupled to a 1:12 voltage transformer, 53, across an initial linear inductor $L_0$ to a capacitive-inductive ladder network, 55, comprising a series of substantially identical capacitors $C_1, C_2, \ldots, C_N$ coupled by saturable inductors $L_1, L_2, \ldots, L_N$ as shown. The ladder network 55 is coupled to ground across a terminal resistor, R, and the non-linear or saturable inductors of inductances $L_p$, satisfy the relations $$L_p^{(unsat.)}/L_p^{(sat.)} \geqq f(p=1, 2, \ldots, N) \text{ and}$$

$$L_p^{(sat.)}/L_{p+1}^{(sat.)} \geqq g(p=1, 2, \ldots, N-1),$$

where f and g are predetermined numbers, each greater than or equal to 10. Preferably, f and g should be as high as possible, as high as 400 if such materials are available. As used herein, the term "capacitive-inductive ladder network" means a network comprising a sequence of N(≧2) capacitors $C_1, \ldots, C_N$ arranged in parallel with each other and with a single resistor, R, at one end, all grounded at a common capacitor terminal, and a sequence of N inductors $L_1, \ldots, L_n$, with inductor $L_n$ ($n=1, \ldots, N-1$) coupling the non-grounded terminals of capacitors $C_n$ and $C_{n+1}$ and inductor $L_N$ coupling the capacitor $C_N$ and the resistor R.

Figure 6:
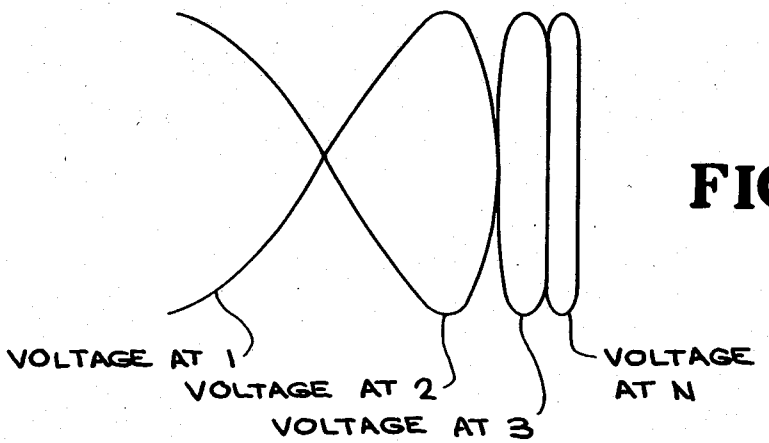
FIG. 6 is a graphic view of magnetic pulse compression at several points of the network in FIG. 5.

The ladder network 55 shown in FIG. 5 operates as follows. Capacitor $C_1$ charges through the inductor $L_0$ until the inductor $L_1$ saturates (this occurs at high currents) and achieves an inductance much less than that of $L_0$. When this occurs, the capacitor $C_2$ beings to charge from $C_1$ through $L_1^{sat.}$; but since the inductance of $L_1^{sat.}$ is much less than the inductance of $L_0$, $C_2$ charges much more rapidly than $C_1$ did (faster by a factor of 4 or better). This process continues through the successive stages until $C_N$ discharges into the load through the inductor $L_N^{sat.}$. FIG. 6 indicates the time duration of the successive voltage pulses developed at the network points 1, 2, 3, . . . , N indicated in FIG. 5. The apparatus shown in FIG. 5 is useful in explaining the principle of magnetic compression of a pulse, but the preferred embodiment of the pulse-forming network used herein is quite different (FIG. 7).

To ensure efficiency in this process, saturation at each stage occurs at the peak of the voltage waveform passing that stage. With reference to FIG. 4, segment a–b is the active or high permeability region during which the (non-linear) inductor impedes current flow; the leveling off of the hysteresis curve at b and its continuation to e indicates that core saturation has been achieved, and the inductor achieves a very low impedance in this region. During the segment e–c–d–a, the core is reset to its original state for the next cycle.

Figure 7:
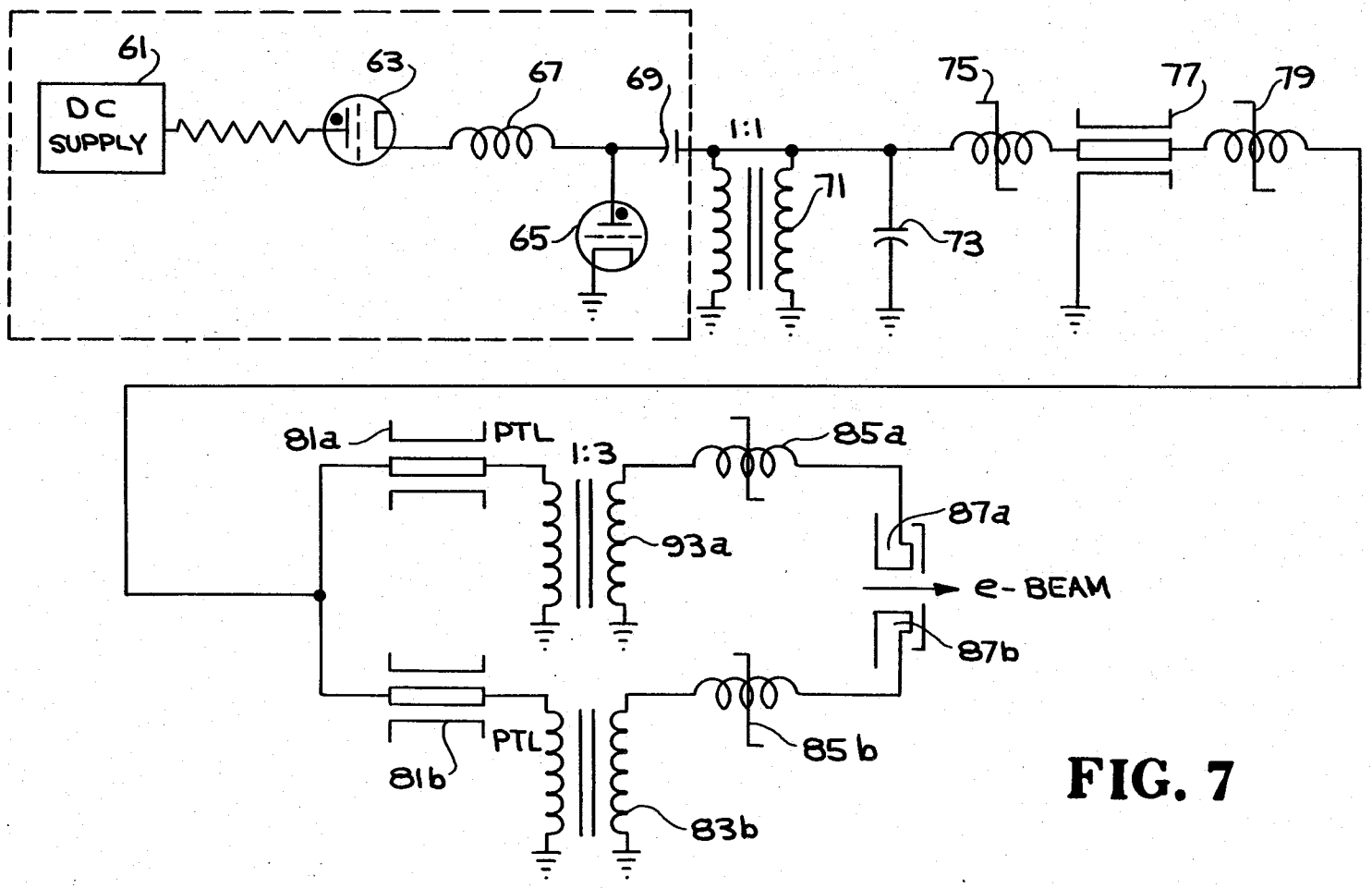
FIG. 7 is a schematic view of one embodiment of the pulse-forming network according to the invention.

FIG. 7 exhibits the pulse-forming network according to a preferred embodiment of the invention. One begins with a dc power supply with power delivery, 61, resistively coupled to a first thyratron or other switch, 63, having a recovery time of no more than 20 μsec. (repetition rate ~ 20 kHz). The first thyratron is inductively coupled to a second, similar thyratron or switch, 65, through a linear inductor, 67, having inductance $L \approx 10^{-4}$ henrys. The two thyratrons or switches and the linear inductor act as a first switch to produce a voltage pulse of approximately 28 kV of approximately 50 μsec. time duration (1- cos ωt) [in] for discharging a capacitor 69. The [(2 μfarad]capacitor [),] 69 [,](substantially 2 μfarad) is discharged by thyratron (switch) 65 and applied to a step-up transformer (1:12), 71, that steps the voltage up to approximately 336 kV. At this point, the output pulse has a time duration of about 1 μsec (1-cos ωt).

The transformer output pulse charges a capacitor, 73, with $C \approx 14$ nfarads (e.g., using a water capacitor for energy storage) and is also coupled to a non-linear or saturable inductor, 75, that has $L^{(unsat.)} \approx 10$ millihenrys and $L^{(sat.)} \approx 1$ μhenrys. The output of the saturable inductor after saturation is a 336 kV voltage pulse of time duration $\Delta t \approx 250$ nsec. (FWHM), and this output moves through a 2-ohm impedance pulse transmission line (e.g., distributed energy storage in water), 77, to a second saturable inductor, 79 with $L^{(sat.)} \approx 20$ nH and $L^{(unsat.)} \approx 20$ μH. The output of the inductor 79 after saturation is a 168 kV voltage pulse with 20 nsec. rise time and fall time (10%–90%) and 80 nsec. time duration (FWHM). This output is fed to two equal length, 4-ohm impendance water-filled transmission lines, 81*a* and 81*b*, that are coupled, respectively, across two voltage step-up (1:3) transformers, 83*a* and 83*b*, [1:3 step-up transformers] and two saturable inductors, 85*a* and 85*b*, of $Z_o^{(sat.)} = 36$ ohms and $Z_o^{(unsat.)} = 720$ ohms to two sides, 87*a* and 87*b*, of the ferrite-loaded accelerator module toroid (e.g., 43 in FIG. 2). The outputs of the inductors 85*a* and 85*b* are 500 kV voltage pulses with 10 nsec. rise time and fall time (10%–90%) and 70 nsec. time duration (FWHM) with a plateau of 0–50 nsec., or longer if desired.

One of the most critical elements of the magnetic pulse compressor is the material in the final inductor stages. The only material currently available that affords high efficiency and fast rise times is the class of new so-called ferromagnetic metallic glasses. A metallic glass is a metal that has been liquified and then solidified so rapidly (approximately $10^6$ degrees per second) that it has no time to form the usual crystal structure and instead forms an amorphous solid structure. This can be done by directing a thin jet of the molten metal or alloy onto a chilled, rapidly rotating metal disk or cylinder. This automatically forms a ribbon of metallic glass no more than about 28 μm thick that spins off at a very high rate. The metallic glass used in our saturable inductors or to replace our ferrite cores for the accelerator modules is either iron-based or an alloy of cobalt and iron that yields a higher saturation flux.

The metallic glass available from Allied Corporation has a saturation magnetic induction (point b on the curve in FIG. 4) of 14–18 kilogauss, depending upon the material composition, the repetition rate or frequency of cycling, and other parameters. The Metglas® Alloy 2605 SC, composed almost exclusively of iron, manifests a (static) knee induction of $B_{knee} = 13.8$ kilogauss at a magnetic force of $H_{knee} = 0.4$ Oersteds, and these numbers increase monotonically to $B_{knee} = 15.5$ kilogauss and $H_{knee} = 0.85$ Oersteds at a repetition rate of 1 kHz. The saturation magnetic induction of 2605 SC appears to be 15.7 kilogauss (as cast) or 16.1 kilogauss (annealed) and does not vary appreciably with applied frequency. This material is a general purpose, "soft" magnetic alloy. Another material of interest, Metglas® Alloy 2605 CO, an iron-cobalt compound, has higher (static) knee point ($B_{knee} = 15.5$–$16.5$ kilogauss, $H_{knee} = 0.1$–$0.9$ Oersteds) and higher saturation magnetic induction ($B_{sat} = 17.5$ kilogauss as cast and 18.0 kilogauss annealed) and is well suited to operations above 1 kHz. Other alloys such as 2650 S-2 or S-3 offer low core loss operation at frequencies greater than 1 kHz but have lower knee and saturation field values.

For short pulses, the dominant factor in core losses is the presence of eddy currents, with the losses scaling as the square of the core material thickness and inversely with the resistivity of the core material. Amorphous metals or metallic glasses have resistivities about three times as high as the same material in its usual crystalline form and can be mass produced in ribbons of no more than about 28 μm thick. These materials are thus ideal for generating fast pulses with high efficiency as the eddy currents are quite low in such materials.

Although the preferred embodiment of the subject invention has been shown and described herein, variation on and modification of the invention may be made without departing from the scope of the invention.

What is claimed is:

1. Apparatus capable of acceleration of electrons to energies of at least 1 MeV at currents of at least 100 A over a time interval of at most 1 μsec. and pulse repetition rates of up to 20 kilohertz, the apparatus comprising:

an electron beam injector for generating focused beam of electrons of energy substantially ≧0.1 MeV;

a plurality of substantially identical accelerator modules, each module serving to receive the beam of electrons and to increase their kinetic energies by substantially 0.1–1.0 MeV, each module having a module axis that is coaxial with the axis of the electron beam injector, each accelerator module comprising:

a toroid of ferromagnetic material, with the axis of the toroid being coaxial with the electron beam injector axis and with the inner diameter of the toroid being sufficient to allow the electron beam produced by the electron beam injector to pass through the hollow center of the toroid along the toroid axis;

a hollow cylindrical electrical conductor, with cylinder axis coaxial with the toroid axis, adjacent to the toroid and making at least one complete turn around the toroid generator, for thereby transporting a voltage pulse about the toroid and abruptly changing the magnetic induction of the toroid ferromagnetic material; and a pulse-forming network, electrically connected with the cylindrical electrical conductor and operatively associated with the electron beam injector, for generating a voltage pulse of duration of ≦1 μsec. of 0.1–1.0 megavolt maximum voltage, in timed relationship with production of an electron beam by the electron beam injector, and for delivering this voltage pulse to the cylindrical electrical conductor;

with the pulse-forming network comprising:

initial pulse generation means, having an output terminal, to produce a voltage pulse of time duration no more than 50 microseconds and voltage substantially ≧10 kV at the output terminal; and a magnetic compression network with an input terminal and an output terminal coupled to the output terminal of the initial energy storage means, for receiving at its input terminal the ≧1 microsecond voltage pulse from the initial energy storage means and for producing at its output terminal a ≧100 kV voltage pulse of duration ≦1 μsec. with substantially a ≧5 nanosecond rise time and fall time, the network comprising:

a grounded capacitor coupling the output terminal of the initial energy storage means to ground;

a first saturable inductor having two ends and having inductances satisfying $L^{(unsat.)}/L^{(sat.)} \geqq 100$, connected to one initial energy storage means output terminal at the first end of the inductor;

a water-filled pulse transmission line having two ends and having impedance of substantially ≧0.1 ohms, connected at one end to the second end of the first saturable inductor;

a second saturable inductor having two ends and having inductances satisfying $L^{(unsat.)}/L^{(sat.)} \geqq 100$, connected at one end to the second end of the water-filled pulse transmission line;

two substantially identical water-filled pulse transmission lines of equal length, connected at one end of each of these two transmission lines to the second end of the second saturable inductor;

two substantially identical voltage step-up transformers, each being coupled at its input terminal to the second end of one of the second or third, respectively, pulse transmission lines; and two substantially identical saturable inductors, each being coupled at one end to the output terminal of the second or third, respectively, voltage step-up transformer and each having inductances satisfying $L^{(unsat.)}/L^{(sat.)} \geqq 100$, with the second end of each of the third and fourth saturable inductors being connected to separate electrical conductors that each contain two or more loops around the toroid of the accelerator module.

2. Apparatus according to claim 1, wherein said saturable inductors in each of said pulse-forming networks includes thin ribbons of amorphous ferromagnetic metal separated by thin ribbons of dielectric material.

3. Apparatus according to claim 2, wherein said amorphous ferromagnetic metal is selected from a group consisting of iron and an alloy of iron and cobalt.

4. Apparatus according to claim 2, wherein the thickness of said ribbon is no more than 28 μm.

5. A pulse forming network for generating an initial voltage pulse of time duration substantially ≧1 microsecond and for reforming the pulse as a voltage pulse of at least twice the initial voltage and with a time duration of ≦1 sec. and pulse rise time and pulse fall time of ≧5 nanoseconds each, the apparatus comprising:

initial pulse generation means, having an output terminal, to produce a voltage pulse of time duration no more than 50 microseconds and voltage substantially 10 kV at the output terminal: and a magnetic compression network with an input terminal coupled to the output terminal of the initial energy storage means, for receiving at its input terminal the ≧1 microsecond voltage pulse from the initial energy storage means and for producing at its output terminal a ≧100 kV voltage pulse of duration ≦1 μsec. with substantially a ≧5 nanosecond rise time and fall time, the network comprising:

a grounded capacitor coupling the output terminal of the initial energy storage means to ground;

a first saturable inductor having two ends and having inductances satisfying $L^{(unsat.)}/L^{(sat.)} \geqq 100$, connected to one initial energy storage means output terminal at the first end of the inductor;

a water-filled pulse transmission line having two ends and having impedance of substantially ≧0.1 ohms, connected at one end to the second end of the first saturable inductor;

a second saturable inductor having two ends and having inductances satisfying $L^{(unsat.)}/L^{(sat.)} \geqq 100$, connected at one end to the second end of the water-filled pulse transmission line;

two substantially identical water-filled pulse transmission lines of equal length, connected at one end of each of these two transmission lines to the second end of the second saturable inductor;

two substantially identical voltage step-up transformers, each being coupled at its input terminal to the second end of one of the second or third, respectively, pulse transmission lines; and two substantially identical saturable inductors, each being coupled at one end to the output terminal of the second or third, respectively, voltage step-up transformer and each having inductances satisfying $L^{(unsat.)}/L^{(sat.)} \geqq 100$, with the second end of each of these two saturable inductors being connected to a separate electrical conductor that contains two or more loops around the toroid of the accelerator module.

6. Apparatus according to claim 5, wherein said saturable inductors include thin ribbons of amorphous ferromagnetic material separated by thin layers of dielectric materials.

7. Apparatus according to claim 6, wherein said amorphous ferromagnetic material is drawn from a group consisting of iron and an iron/cobalt alloy.

8. Apparatus according to claim 6, wherein the thickness of said ribbon of ferromagnetic material is no more than 28 μm.

* * * * *